United States Patent [19]

Ulrich et al.

[11] 4,044,527

[45] Aug. 30, 1977

[54] APPARATUS FOR SEALING CONTAINERS

[75] Inventors: Lawrence Walter Ulrich; Connie Wayne Walker, both of Bolingbrook, Ill.

[73] Assignee: Durable Packaging Corporation, Chicago, Ill.

[21] Appl. No.: 700,170

[22] Filed: June 28, 1976

[51] Int. Cl.[2] ..... B65B 7/16

[52] U.S. Cl. ..... 53/137; 53/76; 53/374; 74/222

[58] Field of Search ..... 53/75, 76, 137, 374; 74/222

[56] References Cited

U.S. PATENT DOCUMENTS

| | | | |
|---|---|---|---|
| 3,267,640 | 8/1966 | Romney et al. | 53/374 X |
| 3,410,046 | 11/1968 | Johnson | 53/247 |
| 3,623,293 | 11/1971 | Boulay | 53/374 |
| 3,973,375 | 8/1976 | Loveland | 53/374 |

*Primary Examiner*—Travis S. McGehee
*Attorney, Agent, or Firm*—Joel E. Siegel

[57] ABSTRACT

An apparatus for automatically sealing random sized cartons which includes a unique side arm control mechanism which translates rotary motion to linear motion to push and pull against both ends of each side arm. The apparatus also includes a unique lift mechanism to raise and lower the top sealing means.

7 Claims, 6 Drawing Figures

Fig. 1.
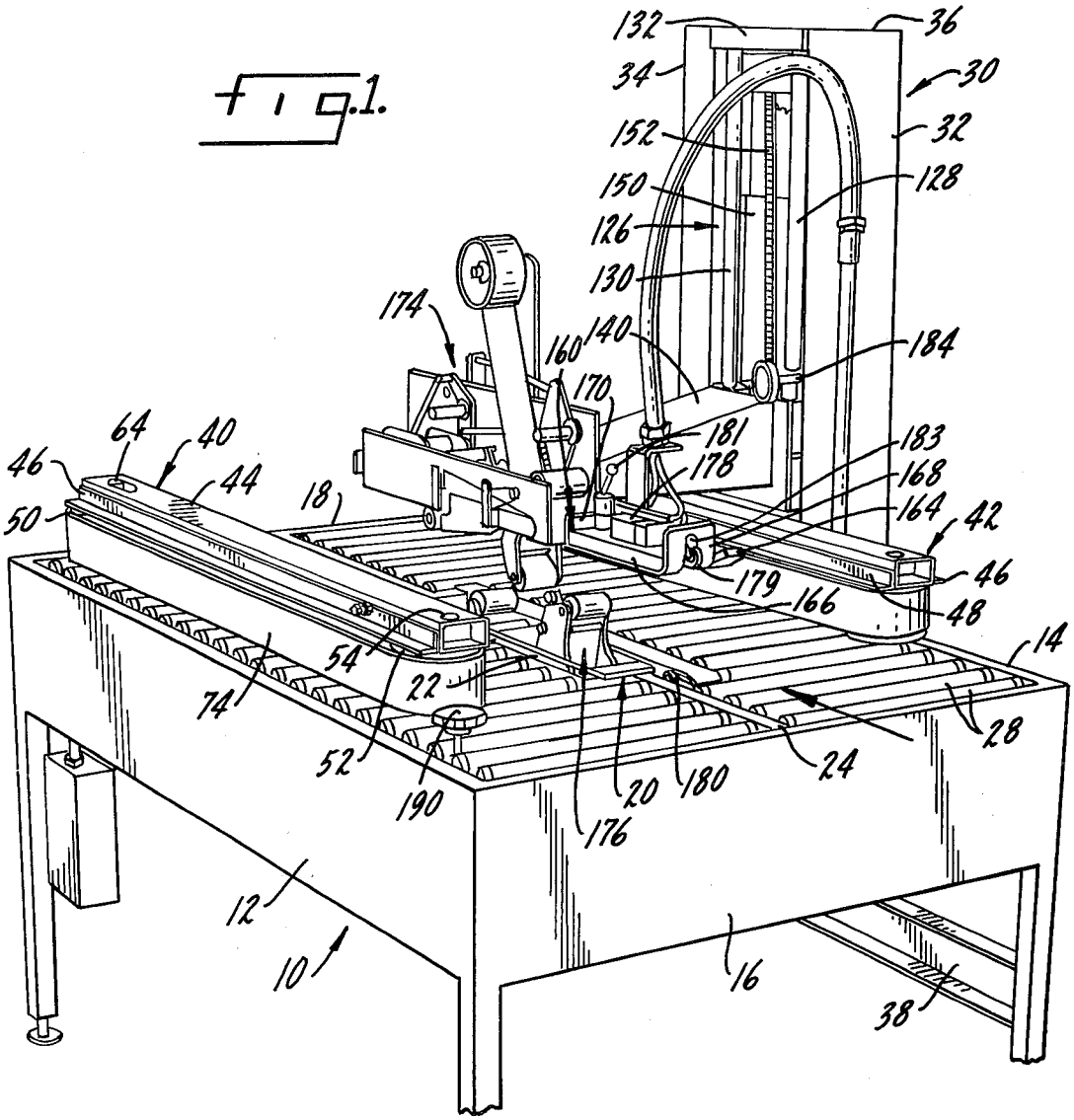
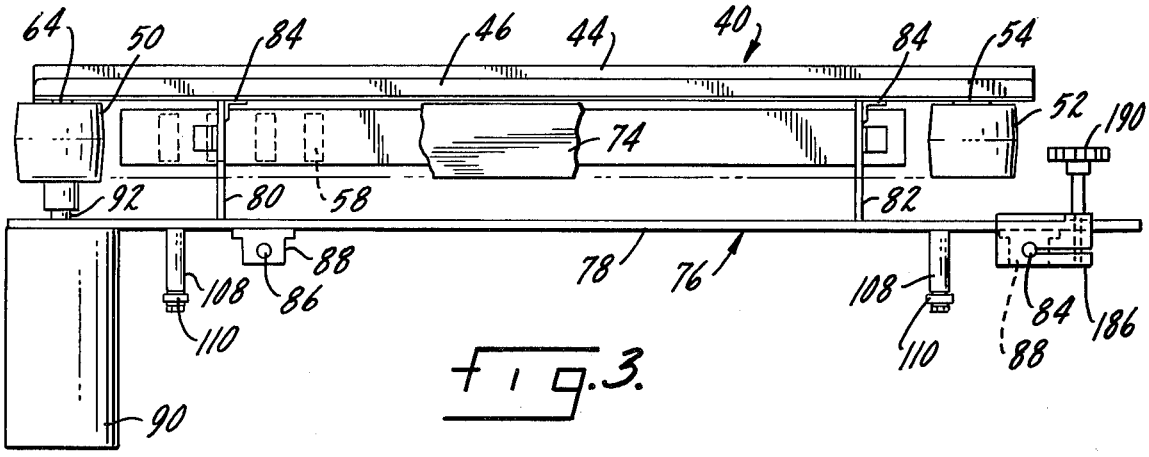
Fig. 3.

fig. 4.
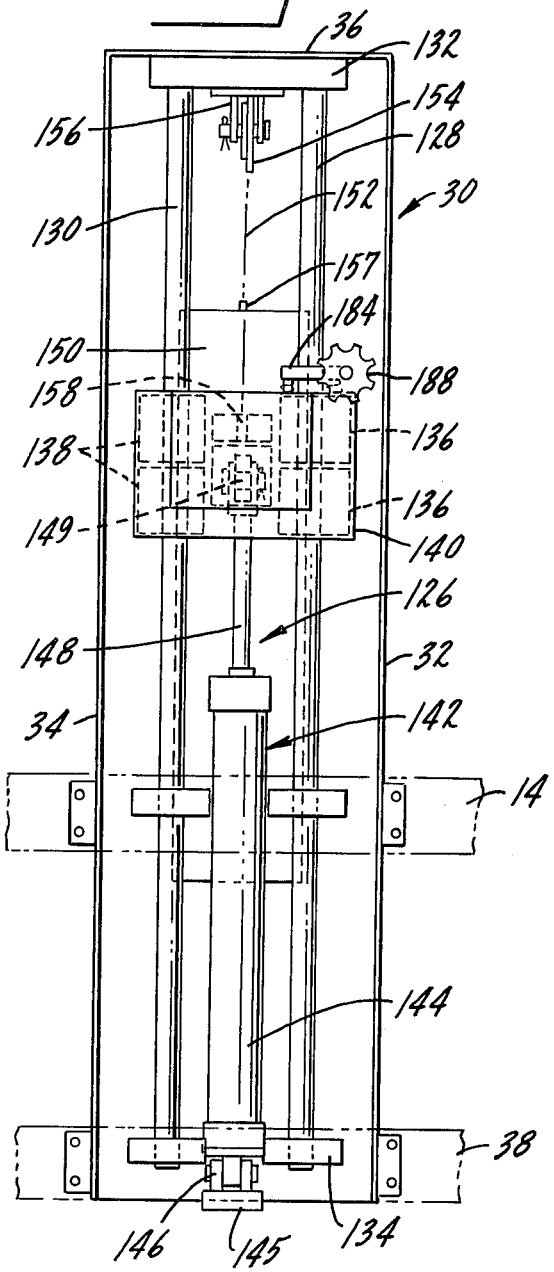
fig. 5.
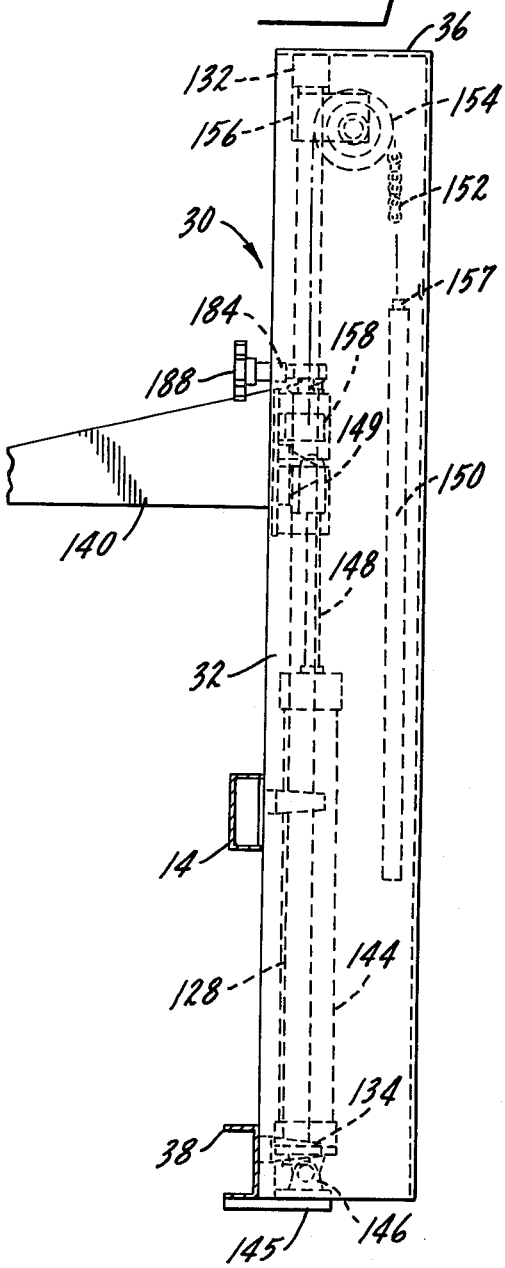
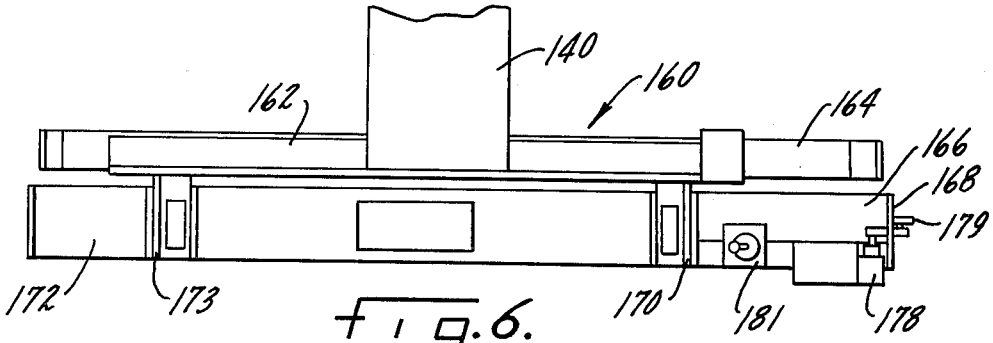
fig. 6.

APPARATUS FOR SEALING CONTAINERS

BACKGROUND AND SUMMARY OF THE INVENTION

The present invention relates to apparatus for the sealing of packaging containers, and more particularly to apparatus for automatically sealing the foldable flaps of cartons of random sizes by applying a self-adhesive tape material along the edges of the flaps.

In the packaging industry, corrugated and fiberboard cartons have been used for many years and various machines have been developed which are capable of sealing the carton either by gluing the flaps, taping the flaps or by stapling or otherwise providing mechanical fasteners to maintain the flaps in a closed position. Many of these machines are designed to accept cartons of random width and height by providing various types of sensing means to control the transverse movement of the carton conveying side arms and the vertical movement of the top sealing means. Over the years these machines have tended to become more complex and expensive and less reliable in operation.

It is a primary object of the present invention to provide an apparatus for automatically sealing the foldable flaps of random sized cartons which is simple in design and reliable in operation.

Another object of the invention is to provide such an apparatus having an improved mechanism to automatically move the carton conveying side arms towards and away from the carton.

A further object of the invention is to provide such an apparatus having an improved mechanism to raise and lower the top sealing means.

A still further object is to provide an apparatus for automatically sealing foldable flaps of random sized cartons which permits manual control to facilitate the handling of a plurality of uniform size cartons sequentially fed therethrough.

The present invention described herein provides an apparatus for automatically sealing random sized cartons in a simple and reliable manner. A unique side arm control mechanism is provided to control the transverse movement of the carton conveying side arms which translates rotary motion to linear motion to push and pull against both ends of each side arm with an equal force to prevent longitudinal misalignment of the side arms. The side arm control mechanism may be adjusted to permit the application of the sealing material in an off center relationship. A unique lift mechanism is also provided to raise and lower the top sealing means in an efficient and reliable manner. For a fuller understanding of the nature and objects of the invention reference should be made to the following detailed description taken in connection with the accompanying drawings.

BRIEF DESCRIPTION OF THE DRAWINGS

FIG. 1 is a perspective view of the sealing apparatus constructed in accordance with the present invention.

FIG. 3 is a sectional view taken along line 3—3 in FIG. 2.

FIG. 4 is a front elevational view of the vertical lift assembly constructed in accordance with the present invention.

FIG. 5 is a side elevational view of the vertical lift assembly shown in FIG. 4.

FIG. 6 is a top plan view of the upper tape head support assembly.

DESCRIPTION OF A PREFERRED EMBODIMENT

Figure 2:
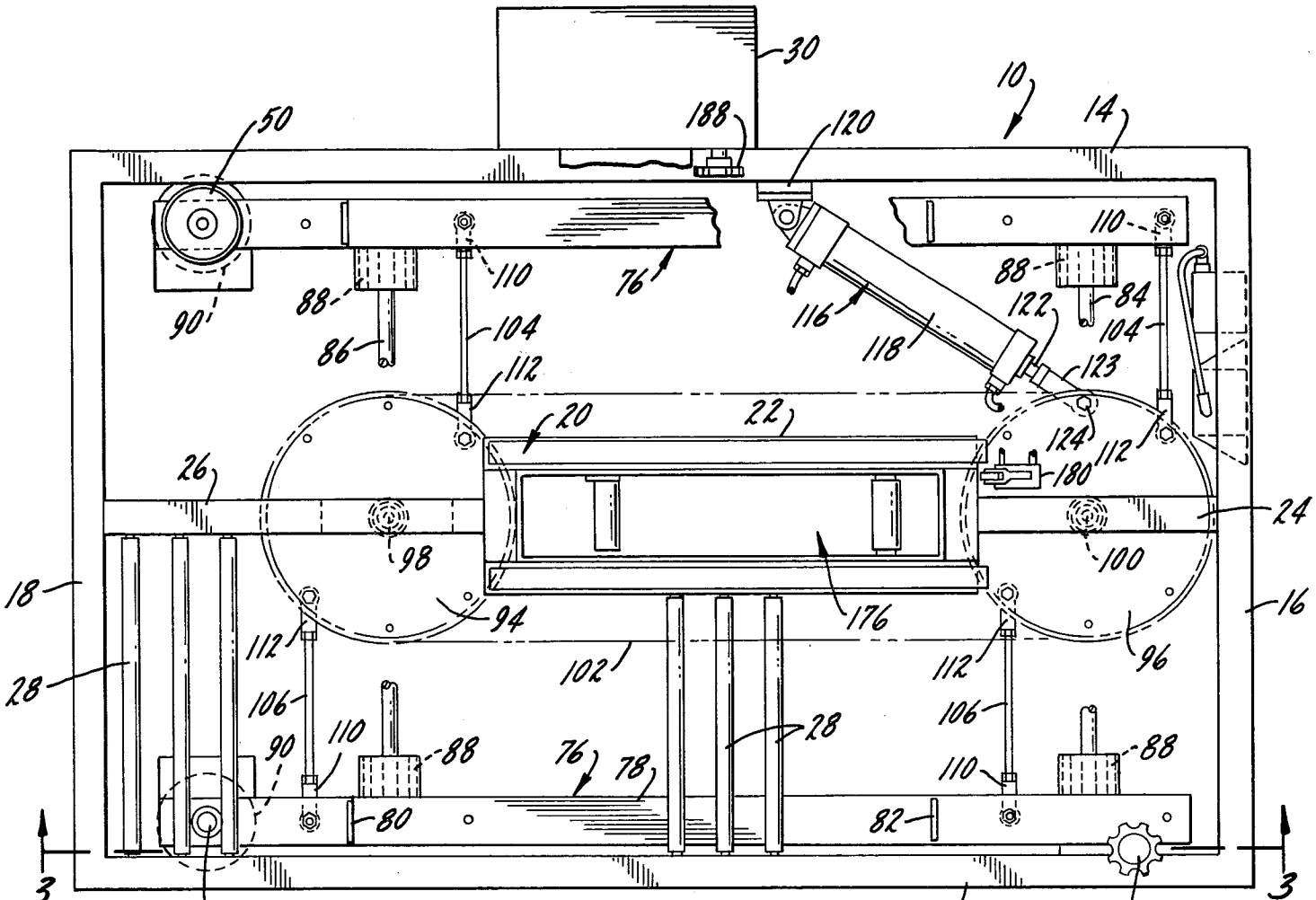
FIG. 2 is a top plan view illustrating the mechanism in accordance with the present invention which controls the movement of the side arm assemblies.

Referring now in detail to the drawings and particularly to FIGS. 1 and 2; the apparatus in accordance with the present invention comprises a frame structure 10 having side walls 12 and 14 and end walls 16 and 18. Extending longitudinally between end walls 16 and 18, parallel to and spaced equidistant from side walls 12 and 14, is a center support structure 20. Structure 20 includes a hollow rectangular structure 22 which is secured to end walls 16 and 18 by channel members 24 and 26. A plurality of transversely disposed and longitudinally spaced carton conveying rollers 28 are journalled for rotation between the support structure 20 and the respective side walls 12 and 14. Extending vertically upward from side wall 14 in transverse alignment with structure 22 is a structural vertical lift housing 30. Lift housing 30 includes side walls 32 and 34 and a top plate 36. Side walls 32 and 34 of housing 30 are suitably secured to frame structure 10 at side wall 14 and at an angle iron member 38 associated with structure 10 below side wall 14, as best seen in FIGS. 4 and 5.

A pair of transversely spaced and longitudinally extending side arm assemblies 40 and 42 are mounted to frame 10 above rollers 28 parallel to side walls 12 and 14, as best seen in FIGS. 1–3. Side arm assemblies 40 and 42 are of substantially identical construction, one being the mirror image of the other. Accordingly, the construction of only side arm assembly 40 will be described herein. Side arm assembly 40 comprises a longitudinally extending closed rectangular channel frame 44 having angle members 46 and 48 secured along its respective vertical sides. The opposite ends of frame 44 are apertured to receive the shaft ends of drive roller assembly 50 and idler roller assembly 52 positioned immediately therebelow. Idler roller assembly 52 includes a shaft 54 suitably journalled for rotation at one end of frame 44. In a similar manner drive roller 50 includes a shaft 64 suitably journalled for rotation at the other end of frame 44. Endless conveyor belts 74 are trained about roller assemblies 50 and 52. Rollers 58 are provided to guide the movement of belts 74.

Referring to FIGS. 2 and 3, side arm assemblies 40 and 42 are mounted to frame 10 for transverse sliding movement towards and away from each other. Positioned below each of the side arm assemblies is a side arm carriage 76 including a longitudinally extending bar 78 and a pair of longitudinally spaced connecting plates 80 and 82 secured at their upper ends to frame 44 through angle members 84 and at their lower ends to bar 78. A pair of longitudinally spaced, rigidly supported, transverse slide shafts 84 and 86 extend between side walls 12 and 14. Slide shaft 84 extends through an opening in member 24 and slide shaft 86 extends through an opening in member 26. Each carriage 76 includes a pair of appropriate bearing assemblies 88 attached thereto to slidably receive an end of each of the slide shafts 84 and 86 therethrough. Carriages 76 and the side arm assemblies 40 and 42 are free to move towards and away from each other about shafts 84 and 86. Each carriage 76 also carries a parallel shaft motor assembly 90 mounted to the underside of one end of each bar 78. Each motor assembly 90 includes a drive shaft 92 extending upward through bar 78 for coupling to a respective drive roller 50.

An important feature of the present invention is the provision of a unique mechanism for effecting the simultaneous movement of each of the side arm assemblies 40 and 42 toward and away from the longitudinal axis of the frame assembly. As best seen in FIGS. 2 and 3, this mechanism includes a pair of longitudinally spaced sprocket wheels 94 and 96 journalled for rotation about a vertical axis. Sprocket wheel 94 is suitably secured to the underside of member 26 to rotate about shaft 98 and sprocket wheel 96 is suitably secured to the underside of member 24 to rotate about shaft 100. An endless chain 102 is received around sprocket wheels 94 and 96 for effecting the transmission of rotating forces applied to one wheel to the other wheel. A pair of horizontally extending threaded connecting rods 104 and 106 are provided to secure a corresponding end of each of the side arm assemblies to each of the sprocket wheels 94 and 96. The connecting rods 104 and 106 associated with each wheel are identical in construction. The outer ends of connecting rods 104 and 106 are pivotally secured to bars 78 through extension rods 108 secured to and extending downward from bar 78. Rods 104 and 106 are secured to rods 108 through spherical rods 110. The inner ends of rods 104 and 106 are pivotally secured to corresponding sprocket wheel 94 and 96 adjacent their outer periphery through spherical rods 112. The inner and outer ends of rods 104 and 106 are respectively threadedly received by spherical rods 110 and 112. It should be noted that the effective length of rods 104 and 106 may be adjusted by increasing or decreasing the length of the rods 104 and 106 received within the spherical rods 110 and 112.

Referring specifically to FIG. 2, a double-acting pneumatic piston and cylinder unit 116 of conventional construction is provided to effect the rotation of sprocket wheel 96 in a clockwise and counter-clockwise direction. Cylinder unit 116 includes a cylinder portion 118 pivotally connected to frame 10, through a clevis bracket 120, and a piston rod end 122 pivotally connected to the underside of sprocket wheel 96 in a suitable manner adjacent its outer periphery through sperical rod 123 and extension rod 124. The cylinder unit 116 serves to effect a controlled rotary movement to sprocket wheels 94 and 96 which is translated to a linear movement to side arm assemblies 40 and 42 in a manner which will hereinafter become more apparent. Connecting rods 104 and 106 push and pull on both ends of side arm assemblies 40 and 42 and thereby prevent longitudinal misalignment of the side arm assemblies 40 and 42.

Referring to FIGS. 1, 4 and 5, a vertical lift assembly 126 is mounted for vertical movement with respect to housing 30. Lift assembly 126 includes a pair of rods 128 and 130 rigidly mounted within housing 30 between mounting blocks 132 and 134. Bearings 136 and 138 are slidably mounted respectively to rods 128 and 130 for vertical movement with respect thereto. Secured to bearings 136 and 138 and extending transversely outward therefrom is a support assembly 140. Support assembly 140 is of suitable design for attachment to bearings 136 and 138 at its outer end and for support of the upper tape head support assembly 160 from its inner end. A single-acting pneumatic piston and cylinder unit 142 includes a cylinder portion 144 pivotally mounted to a plate 145 secured to frame member 38 a clevis bracket assembly 146, and a piston rod end 148 pivotally mounted to support member 140 through a clevis bracket assembly 149. In order to aid in the vertical movement of support member 140 a counterbalancing weight 150 is mounted within housing 30 for vertical movement therein. Weight 150 is connected to one end of chain 152. Chain 152 extends upwardly from the upper end of weight 150 at bracket 157 and is trained about a sprocket assembly 154, carried by a support bracket 156 adjacent the upper end of housing 30, and has its opposite end fixedly secured to support member 140 via bracket 158.

Referring to FIGS. 1 and 6, tape head support assembly 160 is supported above the longitudinal center axis of frame 10. Assembly 160 includes an angle iron member 162 secured intermediate its ends to the inner end of support member 140. A guide bar 164 is secured to the underside of member 162. A head mount infeed bracket 166, having an upturned front end 168, is secured to a front end of member 162 at bracket 170. A head mount exit bracket 172 is secured to a rear end of member 162 at bracket 173. An upper tape sealing head assembly 174 is suitably mounted between brackets 170 and 173.

Referring to FIGS. 1 and 2, a lower tape sealing head assembly 176 is received within frame structure 22 in longitudinal alignment with head 174. Tape head assemblies 174 and 176 may be of any well known structure generally available to the industry. Tape heads 174 and 176 are automatic taping mechanisms which apply a longitudinally directed strip of tape to the top and portions of the ends of the carton being progressed through the taping mechanism for the purpose of sealing the carton closure flaps in a down-folded condition.

To control the sequential movement of the side arm assemblies 40 and 42 and the vertical lift assembly 126, pneumatic switches 178 and 180 are provided to sense the relative position of the carton as it enters the apparatus. Pneumatic switch 178 is secured to infeed bracket 166 and extends forwardly through an opening 183 in front end 168. Pneumatic switch 178 is positioned to contact the leading side of the carton as it enters the apparatus actuating the pneumatic cylinder 142 to raise lift assembly 126. Pneumatic switch 180 is secured to channel member 24 of frame 10 a short distance ahead of lower tape head 176. Switch 180 is mounted to contact the bottom leading edge of the carton as it enters the apparatus actuating pneumatic cylinder 116 to rotate sprocket wheels 94 and 96 and move side arms 40 and 42 into contact with the sides of the carton. Switch 180 has a time delay built into the switch to cut off the air supply to cylinder 116 after a predetermined period of time. A switch 181 is provided to selectively close down the supply of air to cylinders 116 and 142. The pneumatic system required to selectively supply compressed air to cylinders 116 and 142 is of conventional design and consequently a detailed description thereof is not deemed necessary.

Referrings to FIGS. 3 and 4, the apparatus in accordance with the present invention includes stop means 184 and 186 to respectively clamp the vertical lift assembly 126 and the side arms 40 and 42 in fixed positions. This facilitates the operation of the apparatus in the instance when a long run of cartons of the same dimension is contemplated. Stop means 184 is secured to bearing 136 and extends around rod 128. Rotation of knob 188 is effective to selectively clamp stop means 184 to rod 128 and thereby prevent the vertical movement of lift assembly 126. Stop means 186 is secured to bar 78 and moves therewith about shaft 84. Rotation of knob 190 is effective to selectively clamp stop means 186 to bar 78 and thereby prevent the transverse movement of side arms 40 and 42.

The modus operandi of the apparatus according to the invention will now be described with reference to the drawings as described above.

At the start of operation with no cartons in the apparatus, side arms 40 and 42 are at their outermost positions and lift assembly 126 is at its lowermost position. Stop means 184 and 186 are in their unlocked positions permitting the respective movement of side arms 40 and 42 and lift assembly 126. Power is supplied to motors 90 causing the movement of endless conveyor belts 74 about roller assemblies 50 and 52.

The carton to be sealed is positioned on rollers 28 adjacent end wall 16. The upper flaps of the carton are closed either manually by the operator or automatically by a closing mechanism (not shown) of a type well known in the art. The carton is positioned such that the longitudinal edges of the carton flaps are in substantial alignment with the longitudinal center axis of frame structure 10. The carton is moved inwardly in the direction of the arrow in FIG. 1 until the leading side of the carton pushes against and activates pneumatic switch 178. The activation of switch 178 actuates pneumatic cylinder 142 to raise lift assembly 126 until contact is broken as the leading upper edge of the carton passes under switch 178. It should be noted that switch 178 is pivoted about a horizontal axis and includes a front roller 179 to facilitate its movement up the leading side of the carton. As the movement of the carton continues inwardly the front roller 179 of switch 178 rides over the leading edge of the carton inactivating switch 178 so as to stop the upward vertical movement of lift assembly 126. Tape head support assembly 160 rests on the top of the carton with a gravitational force reduced by counterbalance weight 150.

Simultaneously with the vertical movement of lift assembly 126, as the carton moves inwardly its leading lower edge contacts and activates pneumatic switch 180. The activation of switch 180 actuates pneumatic cylinder 116 to rotate sprocket wheels 94 and 96 in a clockwise direction which in turn pulls the inner ends of rods 104 and 106 towards the longitudinal center axis of the frame 10. This movement of rods 104 and 106 is effective to pull side arms 40 and 42 secured to the outer ends thereof at carriages 76 towards each other across shafts 84 and 86 into contact with the sides of carton. Endless conveyor belts 74 remain in contact with the carton sides and continue the movement of the carton past the taping head assemblies 174 and 176.

As the carton is moved by side arms 40 and 42 past the taping head assemblies 174 and 176 a strip of sealing tape is respectively applied across the top and bottom surfaces and portions of the side surfaces of the carton, sealing the flaps in a closed position. Since the taping heads 174 and 176 may be of any well known construction and consequently are not an important part of the invention, it is not deemed necessary or advisable to disclose or discuss herein the operation of same.

After the carton clears the exit bracket 172 the lift assembly 126 and tape head support assembly 160 are returned to their original or lowermost position by gravitational forces. Also, as the lower trailing edge of the carton passes over switch 180 the time delay built therein is activated after which the pneumatic cylinder is caused to rotate the sprocket wheels 94 and 96 in a counter-clockwise direction causing the side arms 40 and 42 to return to their original or outermost position. The sealed carton is then removed from the apparatus adjacent end wall 18 and the procedure is repeated for the next carton.

The apparatus of the present invention provides means to facilitate its operation when handling a sequence of cartons of the same dimensions. In such an instance the source of compressed air to the apparatus is closed off by switch 181. The side arms 40 and 42 are moved into contact with the sides of the carton and locked in place by stop means 186. The tape head support assembly 160 is positioned to rest on top of the carton and locked in place by stop means 186. After movement of the endless belts 74 is initiated, the cartons may then be introduced into the apparatus in a similar manner as above. Since there is no movement of the side arms 40 and 42 or the head support assembly 160, the cartons may be continuously fed into the apparatus with only a small minimum spacing therebetween.

Another feature of the present invention is its ability to secure and tape only the bottom flaps of a carton. For such operation the tape head support assembly 160 is locked in place by stop means 184 at its uppermost position. At such position switch 178 will not make contact with the carton and consequently there is no actuation of the lift assembly 126. The apparatus may then be operated in accordance with either of the procedures mentioned above. In a similar manner only the top flaps of a carton may be taped by locking the side arm assemblies 40 and 42 in their outermost position by stop means 186.

The apparatus of the present invention may also be adjusted to apply the sealing tape in an off centered relationship to the carton. By adjusting the lengths of rods 104 relative to lengths of rods 106 the relative distances from the center axis of the apparatus of the side arm assembly 40 and the side arm assembly 42 may be varied. By so varying this relationship, the carton can be caused to pass through the taping heads in an off center relationship.

While the apparatus described above is specifically designed for use with tape applying assemblies, it will be appreciated that cartons may be sealed in other well known ways such as gluing, stapling and the like. The tape head assemblies 174 and 176 may be replaced by glue applicators and staplers such as are well known in the art. It will further be apparent to one skilled in the art that the apparatus of the present invention may be utilized to apply a strip of tape to various other types of packaging containers.

The foregoing is a description of a preferred embodiment of the invention which is given here by way of example. The invention is not to be taken as limited to any of these specific features as described but comprehends all such variations thereof as come within the scope of the appended claims.

What is claimed is:

1. Apparatus of the type used for sealing the foldable flaps of cartons of random sizes, said apparatus including a frame structure, a vertically movable sealing head means mounted to said frame structure, and carton conveying means having a pair of facing longitudinally extending side arm means mounted to said frame structure so as to permit transverse movement of said side arm means towards and away from each other, said side arm means having endless conveyor belts engageable with opposite sides of said carton to move same through said sealing head means; an improved mechanism for transversely moving said side arm means towards and away from each other comprising:

a. a pair of longitudinally spaced sprocket wheels supported for simultaneous rotation about a substantially vertical axis;

b. a pair of substantially horizontal connecting rods associated with each of said sprocket wheels, each of said connecting rods having first ends pivotally secured to said sprocket wheels and second ends pivotally secured to corresponding ends of said side arm means; and c. means for rotating said sprocket wheels in a clockwise and counter-clockwise direction, such rotary motion of said sprocket means being translated to linear motion at said side arm means through said connecting rods.

2. The invention as defined in claim 1 wherein said means for rotating said sprocket wheels includes an air cylinder having a first end pivotally secured to said frame structure and a second end pivotally secured to one of said sprocket wheels.

3. The invention as defined in claim 2 wherein said connecting rods are adjustable in length so as to permit sealing in an off-center relationship.

4. The invention as defined in claim 2 wherein said side arm means are mounted to slide on a pair of transverse shafts secured to said frame means.

5. The invention as defined in claim 4 including stop means for selectively securing said side arm means to said transverse shafts.

6. The invention as defined in claim 1 wherein each of said side arm means includes a pair of longitudinally spaced rollers around which said endless conveyor belts are supported for longitudinal movement.

7. The invention as defined in claim 6 wherein each of said side arm means includes a motor means mounted immediately below one of said rollers for directly driving said roller.

* * * * *